US005216794A

United States Patent [19]

Sigmund

[11] Patent Number: 5,216,794

[45] Date of Patent: Jun. 8, 1993

[54] TOOLS FOR SECURING DISC SUPPORTS AND FLUORETTE SOCKETS TO A WALL OR CEILING OF A DOLL HOUSE

[76] Inventor: Mark Sigmund, 777 Dunlon Ave., West Hempstead, N.Y. 11552

[21] Appl. No.: 765,154

[22] Filed: Sep. 23, 1991

[51] Int. Cl.[5] ..... B25B 27/14

[52] U.S. Cl. ..... 29/275

[58] Field of Search ..... 29/275, 254, 255, 278; 72/476, 429, 477; 81/44, 53.1, 53.11; 140/147

[56] References Cited

U.S. PATENT DOCUMENTS

| | | | |
|---|---|---|---|
| 2,013,758 | 9/1935 | Livermore | 72/477 |
| 3,304,602 | 2/1967 | Osborne | 29/275 |
| 4,520,997 | 6/1985 | Lorton | 81/44 |
| 4,793,592 | 12/1988 | Green et al. | 254/134 |

*Primary Examiner*—Robert C. Watson

*Attorney, Agent, or Firm*—Scully, Scott, Murphy & Presser

[57] ABSTRACT

First and second mounting tools for securing disc supports and fluorette sockets respectively, to a wall or ceiling of a doll house are disclosed. The first mounting tool includes a cylindrical member having a first axial cylindrical bore formed at a first end of the cylindrical member for holding the disc support. The first mounting tool also includes a second axial cylindrical bore which extends from a bottom surface of the first cylindrical bore. The second mounting tool includes a circular disc member having a groove on its top surface for holding the fluorette socket. A cylindrical stem extends perpendicularly from a center of a bottom surface of the disc member and is adapted to interfit with the second cylindrical bore of the first mounting tool.

6 Claims, 1 Drawing Sheet

TOOLS FOR SECURING DISC SUPPORTS AND FLUORETTE SOCKETS TO A WALL OR CEILING OF A DOLL HOUSE

BACKGROUND OF THE INVENTION

The present invention relates to tools for attaching and securing disc supports and fluorette sockets to a wall or ceiling of a doll house.

In a doll house, a disc support is attached to a wall or ceiling of the doll house and is used for supporting a ceiling canopy. The ceiling canopy in turn is used to support a miniature chandelier or other light fixture. Examples of such disc supports and interconnecting ceiling canopies are the CK800 and CK800-1 sold by Cir-Kit Concepts, Inc. The disc support is disc shaped and is equipped with two grooves and two imbedded nails which extend from a bottom surface of the disc support. The two nails are used to attach and secure the fixture support to the ceiling and to make an electrical connection with electrical tape which runs along the wall or ceiling of the doll house and is connected to a power supply, such as a step down transformer. After the disc support is attached to the wall or ceiling, the ceiling canopy is connected to the support by placing two pins, which are located inside an open end of the canopy, inside the grooves of the disc support and twisting the ceiling canopy by a quarter turn.

To attach the disc support to the wall or ceiling of the doll house, an installer places the support on the tip of a finger and aligns the nails with the tape run. Next, the nails are pushed into the wall by the force of the installer's finger against the support. However, the walls and ceilings of a doll house are composed of compressed wood. An installer's finger is usually not strong enough and cannot get the appropriate leverage needed to apply a sufficient force to the support such that the nails fully enter the wall and the bottom surface of the socket is flush with the wall or ceiling. This results in the disc supports being loosely attached which frequently causes the supports to fall off the walls or ceilings when the chandelier or other fixture is connected to the support or when bulbs are replaced.

Fluorette sockets which are designed for use with a miniature fluorescent shaped bulb are used as a light fixture in a doll house. An example of such a socket is the CK1019 fluorette socket sold by Cir-Kit Concepts, Inc. The fluorette sockets are rectangular in shape and have a bulb attaching clip at each end to provide for simple bulb installation. Similar to disc supports, fluorette sockets have two imbedded nails in a back surface of the socket and are used to attach it to the wall of the doll house and to make an electrical connection with an electrical tape run.

To attach the fluorette socket to the wall of the doll house, an installer places a finger between the bulb attaching clips, aligns the imbedded nails with the tape run and pushes the socket against the wall. Next, the finger is removed thereby leaving the fluorette socket attached to the wall. However, this method suffers from the same disadvantages as the method used to install disc supports. The installer's finger is usually not strong enough and cannot get the appropriate leverage needed to apply a sufficient force to the socket such that the nails fully enter the wall and the bottom surface of the socket is flush with the wall. This causes the sockets to be loosely attached to the wall and frequently results in sockets falling off the walls when bulbs are replaced.

Thus, there is a need to develop tools that would enable an installer to accurately and securely attach disc supports and fluorette sockets to a wall of a doll house.

SUMMARY OF THE INVENTION

The present invention is directed to interfitting tools for installing disc supports and fluorette sockets to a wall or ceiling of a doll house. In one embodiment of the present invention a first tool is used to secure disc supports to the wall or ceiling. The first tool includes a cylindrical member having a first end and a second end. The first end includes a first axial cylindrical bore extending from the first end of the cylindrical member and terminating at a first bottom surface. The first cylindrical bore is of a size which will interfit with the disc support. A second axial cylindrical bore extends coaxially with the first cylindrical bore from the first bottom surface and terminates at a second bottom surface. In an alternative embodiment, the second cylindrical bore extends coaxially with the first cylindrical bore from the first bottom surface and through the cylindrical member.

In another embodiment of the present invention, a second tool is used to secure fluorette sockets to the wall and ceiling of the doll house. The second tool includes a circular disc member having a top surface and a bottom surface. The diameter of the top surface is less than the distance between bulb attaching clips of the fluorette socket. The top surface has a groove formed therein having a size and shape to interfit with the fluorette socket between bulb attaching clips. A cylindrical stem extends perpendicularly from the center of the bottom surface of the circular disc member and is integrally formed therewith. In a preferred embodiment of the second tool, the stem interfits with the second axial cylindrical bore of the first tool.

The present invention provides for accurate and secure installation of disc supports and fluorette sockets to the walls and ceiling of a doll house. To install the disc support, it is placed in the first cylindrical bore of the first tool with the imbedded nails facing outward and then aligned with a tape run on the wall or ceiling of the doll house. Next, the nails are imbedded into the wall or ceiling by using an instrument to apply a force to the second end of the cylindrical member. Thereafter, the first tool is removed thereby leaving the disc support securely attached and flush with the wall. A fluorette socket can be installed by first inserting the stem of the second tool into the second bore of the first tool. Next, a fluorette socket is placed within the groove of the disc member between the bulb attaching clips with its imbedded nails facing outward. The nails of the fluorette socket are then imbedded in the wall or ceiling of the doll house by using an instrument to apply a force to the second end of the cylindrical member of the first tool. The second tool is then removed thereby leaving the fluorette socket securely attached and flush with the wall.

DETAILED DESCRIPTION OF THE INVENTION

Figure 1:
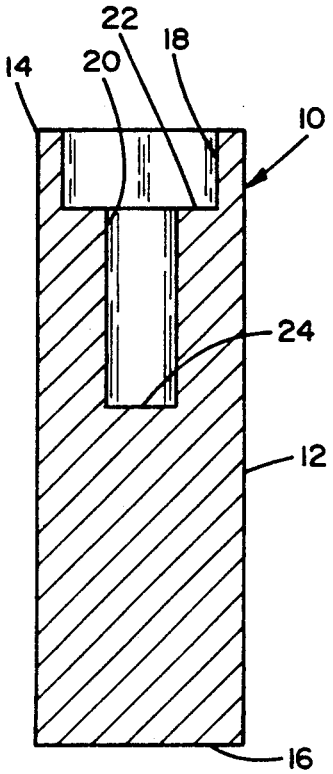
FIG. 1 is a cross-sectional view of the disc support tool of the present invention.

FIG. 1 is a cross-sectional view of a disc support mounting tool 10 of the present invention. The tool 10 includes a cylindrical member 12 having a first end 14 and a second end 16. The tool 10 further includes a first axial cylindrical bore 18 and a second axial cylindrical bore 20. The first cylindrical bore 18 extends from the first end 14 of the cylindrical member 12 and terminates at a first bottom surface 22. The second cylindrical bore 20 extends from the first bottom surface 22 of bore 18 to a second bottom surface 24. Alternatively, the second cylindrical bore 20 can extend fully through the cylindrical member 12. The first cylindrical bore 18 and the second cylindrical bore 20 are preferably axially aligned with each other. The diameter of the first cylindrical bore is of a size such that a disc-shaped support will fit within the cylindrical bore 18. The depth of the first cylindrical bore 18 is preferably approximately one-half of the thickness of the disc support. The diameter of the second cylindrical bore 20 is preferably less than the diameter of the first cylindrical bore 14.

Figure 2:
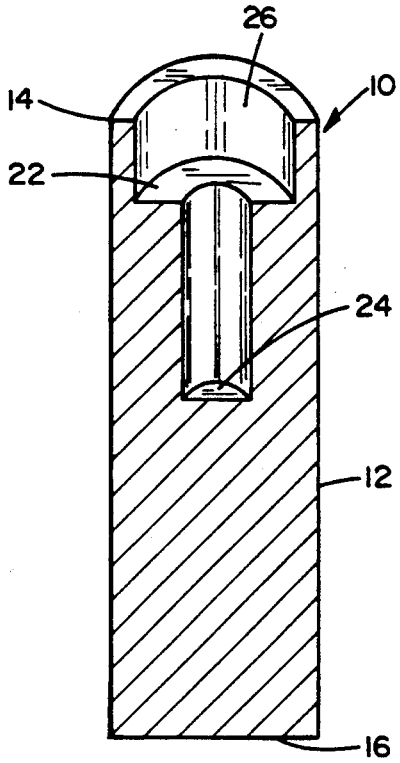
FIG. 2 is a top perspective cross-sectional view of the disc support tool of FIG. 1.

FIG. 2 is a top perspective cross-sectional view of the disc support mounting tool 10 of FIG. 1. As shown in FIG. 2, the first cylindrical bore 18 includes a peripheral wall 26 which extends from the first end 14 of cylindrical member 12 to the first bottom surface 22. The second cylindrical bore 20 extends from the first bottom surface 22 of bore 18 to the second bottom surface 24.

By way of example, the diameter of the first cylindrical bore may be preferably approximately 0.438 inches which is slightly larger than the diameter of a typical disc-shaped support. The depth of the first cylindrical bore 18 is preferably approximately 0.0625 inches. The dimensions of the elements of cylindrical member 12 set forth hereinbelow are by way of example only and it should be understood by those skilled in the art that a wide range of dimensions can be used as long as the tool 10 is compatible for accessibility to the interior of, for instance, a doll house. The axial length of the cylindrical member 12 may be approximately two inches. The axial length of the second bore 20 is preferably less than two inches but may extend entirely through cylindrical member 12. The diameter of the cylindrical member 12 may be approximately 0.5 inches.

The disc support mounting tool 10 is adapted to install disc-shaped supports of the type sold by Cir-Kit Concepts, Inc. and included with ceiling canopies identified by stock numbers CK800 and CK800-1. To install the disc support, it is placed in the first cylindrical bore 18 with its imbedded nails pointing outwardly of the end of the bore 18 beyond the first end 14. The nails are then accurately aligned with a tape run which is located on the wall of the doll house. Thereafter, the nails of the disc support are imbedded in the wall or ceiling of the doll house by using an instrument, such as a hammer, handle of a screwdriver or the like, to apply a force against the second end 16 of cylindrical member 12. The tool 10 is then removed, leaving the disc support securely attached to the wall or ceiling of the doll house. In this manner, the present invention provides accurate alignment of the nails with the tape run and secure flush attachment of the support to the wall.

Figure 3:
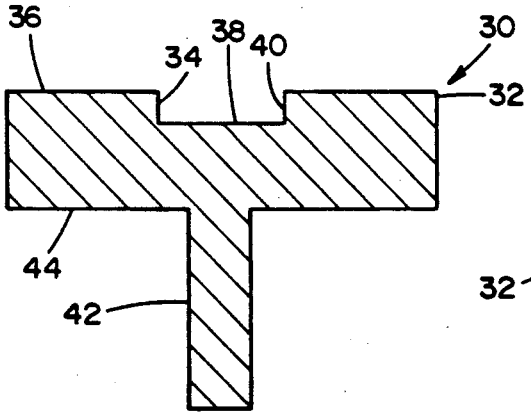
FIG. 3 is a cross-sectional view of the fluorette socket tool of the present invention.
Figure 4:
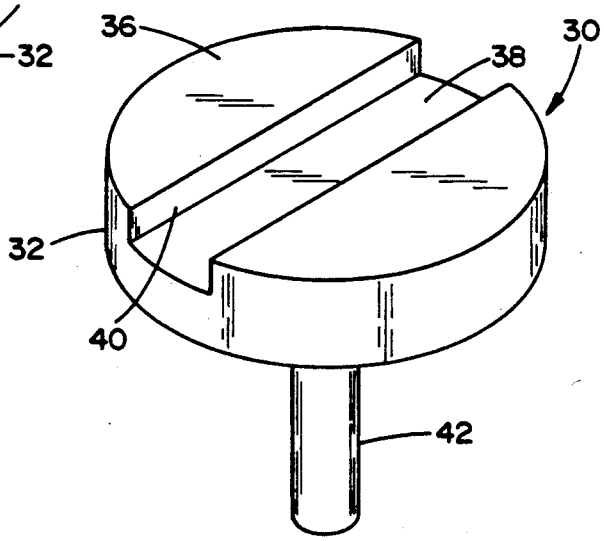
FIG. 4 is a top perspective view of the fluorette socket tool of FIG. 3.

Referring now to FIGS. 3 and 4, there are shown cross-sectional and perspective views of the fluorette socket mounting tool 30 of the present invention. The tool 30 includes a disc member 32, preferably of circular configuration although other shapes may readily lend themselves to the invention, having a linear groove 34 formed in a first surface 36 of member 32. The groove 34 includes a flat bottom surface 38 and two opposite parallel side walls 40. The diameter or external dimensions of the disc member 32 is preferably less than the distance between bulb attaching clips on the fluorette socket. The depth of the groove 34 is preferably approximately two-thirds of the thickness of the fluorette socket and the width of the groove 34 is preferably slightly wider than the width of the fluorette socket. The tool 30 further includes a cylindrical stem 42 which extends perpendicularly from the center of bottom surface 44 of the disc member 32 and is preferably of a size to closely fit into the second cylindrical bore 20 of the disc support mounting tool 10. The cylindrical stem 42 is preferably formed integrally with the disc member 32.

The diameter of the disc member 32 is preferably less than 1.25 inches. The depth of the groove 34 is preferably approximately 0.0625 inches and the width of the groove 34 is preferably about 0.438 inches. The thickness of the disc member 32 can be any value which is compatible with the interior of the doll house and is typically 0.25 inches. The axial length of the stem 42 is preferably approximately equal to the axial length of the second bore 20.

The fluorette socket mounting tool 30 is adapted to install fluorette sockets of the type identified by Cir-Kit Concepts, Inc. stock numbers CK1019 and CK10191. To install the fluorette socket using the tools of the present invention, the stem 42 of the tool 30 is inserted in the bore 20 of the tool 10. Next, a fluorette socket is placed within the groove 34 between its bulb attaching clips and having its imbedded nails facing outward of the groove 34. The nails are then aligned with a tape run on the wall of the doll house. Thereafter, the nails of the fluorette socket are imbedded in the wall of the doll house by using an instrument, such as a hammer, handle of a screwdriver or the like, to apply a force against the second end 16 of cylindrical member 12. The cylindrical member 12 and the interconnected tool 30 are removed together thereby leaving the fluorette socket securely attached to the doll house wall. The fluorette socket tool 30 thus provides accurate alignment of the nails with the tape run and secure flush attachment of the fluorette socket to the doll house wall.

Although the tools 10 and 30 have been described to interfit with each other, it is understood by those skilled in the art that the tools could be fabricated for use independently of each other. For example, the tool 10 could be adapted to be used solely for installing disc supports by only being provided with the first cylindrical bore 18. The tool 30 could likewise be adapted to be used solely for installing fluorette sockets by fabricating the cylindrical stem 42 to have similar dimensions (length and diameter) as the cylindrical member 12.

It should also be understood by those skilled in the art that the elements of the tools according to the present invention may be constructed in a variety of shapes and sizes and are not limited to cylindrical shapes as illustrated in FIGS. 1–4. For example, the member 12 could have a rectangular or other polygonal cross-section and the member 32 could have any shape that provides for the extension of a groove which is capable of holding the fluorette socket in accordance with the present invention.

Any suitable material, for example, aluminum, plastic or other materials may be utilized in fabricating the tools according to the present invention. The tools of the present invention can be fabricated using a machine lathe.

While the invention has been particularly shown and described with respect to the illustrative and preferred embodiments thereof, it will be understood by those skilled in the art that the foregoing and other changes in form and details may be made therein without departing from the spirit and scope of the invention which should be limited only by the scope of the appended claims.

What is claimed is:

1. A composite tool for selectively securing a disc-shaped support having two nails extending perpendicularly from a surface of said disc-shaped support or a rectangular shaped fluorette socket having two nails extending perpendicularly from a first surface of said socket and two bulb attaching clips extending from a second surface which is opposite to said first surface, to a wall of a structure, such as a doll house comprising:

a first tool member including an elongate member having a first end and a second end, a first cylindrical axial bore extending from said first end and terminating at a first bottom surface, and a second cylindrical bore extending coaxially with said first cylindrical bore from said first bottom surface, said second cylindrical bore being of a smaller diameter than said first cylindrical bore, said first cylindrical bore being of a size to receive said-disc-shaped support in close fit therewith such that the two nails of said disc-shaped support point outwardly of said first cylindrical bore beyond said first end of said first tool member;

a second tool member including a holding member having a top surface and a bottom surface, a groove formed within said top surface and configured to support said fluorette socket between bulb attaching clips such that the two nails of said fluorette socket point outwardly of said groove beyond said top surface of said second tool member, and a cylindrical stem extending perpendicularly from the center of said bottom surface of said second tool member, said stem having a size and shape to interfit with said second bore of said first tool such that said first tool member and said second tool member are selectively assembled by inserting the stem of said second tool member into the second cylindrical bore of said first tool member.

2. The composite tool of claim 1 wherein said elongate member of said first tool member has a cylindrical shape.

3. The composite tool of claim 1 wherein said holding member of said second tool member has a circular disc shape.

4. The composite tool of claim 1 wherein said elongate member of said first tool member has a cylindrical shape and said holding member of said second tool member has a circular disc shape.

5. The composite tool of claim 1 wherein said second cylindrical bore extends through said elongate member of said first tool member.

6. The composite tool of claim 1 wherein said second cylindrical bore terminates at a second bottom surface within said elongate member of said first tool member.

* * * * *